US006428358B1

(12) United States Patent
Figueroa et al.

(10) Patent No.: US 6,428,358 B1
(45) Date of Patent: Aug. 6, 2002

(54) SOCKET WITH EMBEDDED CONDUCTIVE STRUCTURE AND METHOD OF FABRICATION THEREFOR

(75) Inventors: David G. Figueroa, Mesa; Chee-Yee Chung, Chandler; Kristopher Frutschy, Phoenix; Farzaneh Yahyaei-Moayyed, Chandler, all of AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/750,419

(22) Filed: Dec. 28, 2000

(51) Int. Cl.[7] ..... H01R 13/648; H01R 4/66
(52) U.S. Cl. ..... 439/608; 439/92
(58) Field of Search ..... 439/108, 92, 607, 439/608, 609

(56) References Cited

U.S. PATENT DOCUMENTS 5,357,404 A * 10/1994 Bright et al. ..... 361/818
5,607,326 A * 3/1997 McNamara et al. ..... 439/608
6,184,460 B1 * 2/2001 Bertoncini et al. ..... 174/35 R

* cited by examiner

*Primary Examiner*—Khiem Nguyen
*Assistant Examiner*—Chandrika Prasad
(74) *Attorney, Agent, or Firm*—Schwegman, Lundberg, Woessner & Kluth, P.A.

(57) ABSTRACT

A socket (300, FIG. 3) includes a housing (302) with multiple openings (304) formed in the top surface. Each opening (304) provides access to conductive contacts (502, FIG. 5), which provide an electrical interface between a device that is inserted into the socket and the next level of interconnect (e.g., a PC board). Embedded within the socket is a conductive structure (310, FIG. 3). In one embodiment, the conductive structure is electrically connected to one or more ground conducting contacts (708, FIG. 7). The conductive structure includes column walls (312), which run in parallel with columns of contacts, and row walls (314), which run in parallel with rows of contacts and which intersect the column walls. In this manner, the conductive structure forms multiple chambers (402, FIG. 4). Each signal carrying and power conducting contact is positioned within a chamber. Accordingly, the walls of the conductive structure function as a ground plane that surrounds the signal carrying and power conducting contacts.

14 Claims, 12 Drawing Sheets

SOCKET WITH EMBEDDED CONDUCTIVE STRUCTURE AND METHOD OF FABRICATION THEREFOR

TECHNICAL FIELD OF THE INVENTION

The present invention relates generally to a socket for an electrical device, and more particularly, to a socket with an embedded conductive structure, and methods of socket fabrication.

BACKGROUND OF THE INVENTION

Various standard package types have emerged for housing microprocessors, multichip modules, memories, transistor networks, and other integrated circuits. These package types include pin grid array (PGA) packages, which include a housing with an array of conductive contact pins that extend away from the bottom surface of the package.

Sockets are commonly used to removably mount PGA packages to printed circuit boards (e.g., mother boards) or other substrates. The socket is electrically and mechanically connected to the circuit board, and the PGA package is inserted into the socket.

FIG. 1 illustrates a top view of a socket 100 in accordance with the prior art. Socket 100 includes a rigid housing 102 having a top surface, which defines a package mounting surface. An array of openings 104 in the top surface corresponds to the array of pins in the package. In addition, the array of openings 104 provides access to a corresponding array of contacts in an interior of the housing.

FIG. 2 illustrates a cross-sectional, side view of the socket 100 of FIG. 1 along section line A—A. An array of contacts 202 resides in cavities below the top surface 204 of the housing 102. The housing captures, supports, and electrically insulates the contacts 202 from each other.

Each of the contacts 202 includes a metal body 206, which is embedded within the socket. In addition, in one embodiment, each contact 202 has a metallic depending lead 210, which extends in a perpendicular direction from the bottom surface 208 and is insertable in a through-hole of a circuit board substrate.

The metal body 206 is configured to allow insertion of a pin of a PGA package into the opening in which the metal body 206 is positioned or into a cavity in the metal body 206 itself. When the pins of a PGA package are inserted into the socket, the PGA package pins physically and electrically contact the metal bodies 206, enabling signals, power, and ground to be exchanged between a circuit board and the PGA package.

The development of microprocessor technology has caused miniaturization and high speed to become important factors in socket design. With miniaturization, the distance between adjacent contacts 202 is becoming smaller and smaller. Because of the close proximity of contacts 202 to each other, crosstalk has become an important performance issue. Crosstalk results from the coupling of the electromagnetic field surrounding an active conductor into an adjacent conductor. When too much crosstalk is present, the integrity of the signals being carried on contacts 202 decreases.

High speed performance requirements have made control of the socket impedance a significant design consideration, as well. Matched impedance at a socket is critical to minimizing signal reflections. False triggering or missed triggering of devices can occur due to reflections that are caused by impedance mismatches.

One method of reducing crosstalk and controlling impedance is to dedicate many contacts 202 as ground contacts, where these ground contacts are located adjacent to the signal carrying contacts 202. Those ground contacts provide nearby termination for the electric fields and thus reduce the coupling between the signal carrying contacts 202. By having ground contacts around the signal contacts, the characteristic impedance of the signal contacts are in tighter control, resulting in better matching between the characteristic impedances of the package and mother board. Therefore, in many high speed PGA packages and socket designs, a substantial number of contacts 202 are dedicated to ground.

The number of ground contacts necessary to ensure the required signal integrity is often expressed in terms of the signal/ground ratio. As this ratio decreases, the performance increases, but the number of pins in the socket that are able to satisfy input/output (I/O) requirements decreases. In many cases, the signal/ground ratio is nearly 1:1. Besides consuming many of the contacts that could otherwise be used for signals, ground contacts are unable to completely control the impedance or factor out the crosstalk.

As circuit frequencies continue to escalate, with their associated high frequency transients, crosstalk and impedance control increasingly become problems in socket designs. Accordingly, what is needed is a socket that has improved grounding, resulting in lower crosstalk and better controlled characteristic impedance. In addition, there is a need for a socket that is able to have a higher ratio of signal to ground pins, without sacrificing performance.

DETAILED DESCRIPTION OF THE INVENTION

Various embodiments of the present invention provide a socket, which includes a housing with multiple openings formed in the top surface. Each opening provides access to conductive contacts, which provide an electrical interface between a device that is inserted into the socket and the next level of interconnect (e.g., a PC board). Embedded within the socket is a conductive structure. In one embodiment, the conductive structure is electrically connected to one or more ground conducting contacts. The conductive structure includes column walls, which run in parallel with columns of contacts, and row walls, which run in parallel with rows of contacts and which intersect the column walls. In this manner, the conductive structure forms multiple chambers. Each signal carrying and power conducting contact is positioned within a chamber. Accordingly, the walls of the conductive structure function as a ground plane that surrounds the signal carrying and power conducting contacts.

Figure 1:
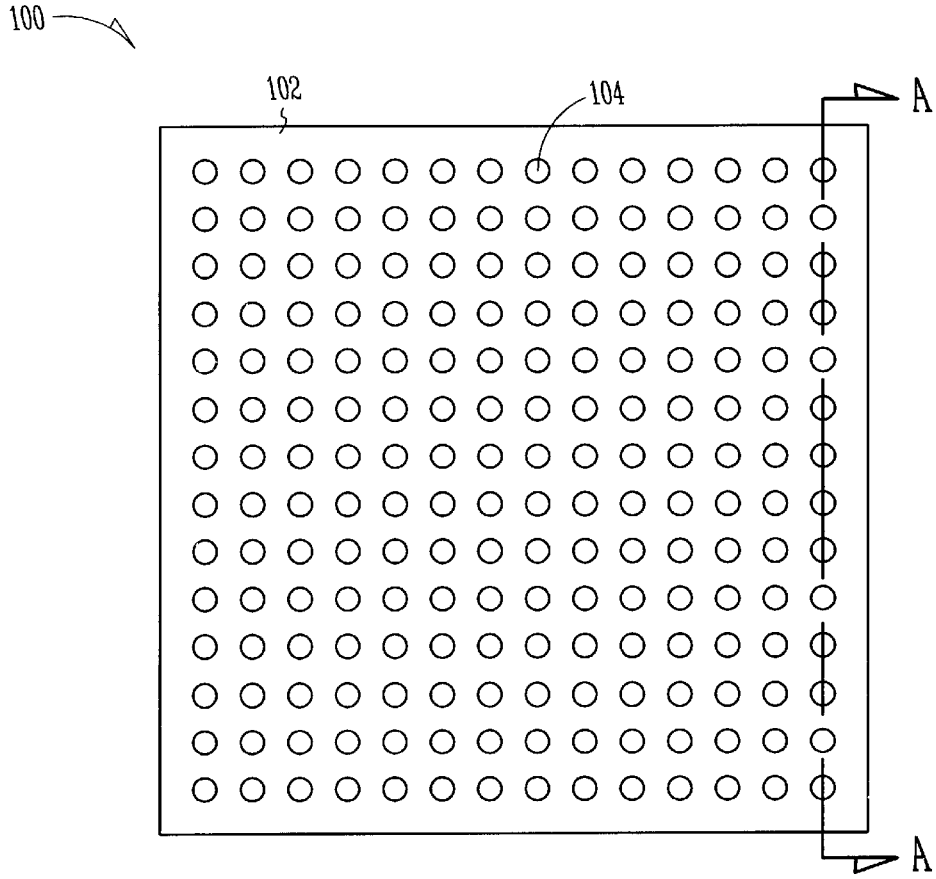
Fig.1 (PRIOR ART)
FIG. 1 illustrates a top view of a socket in accordance with the prior art.
Figure 2:
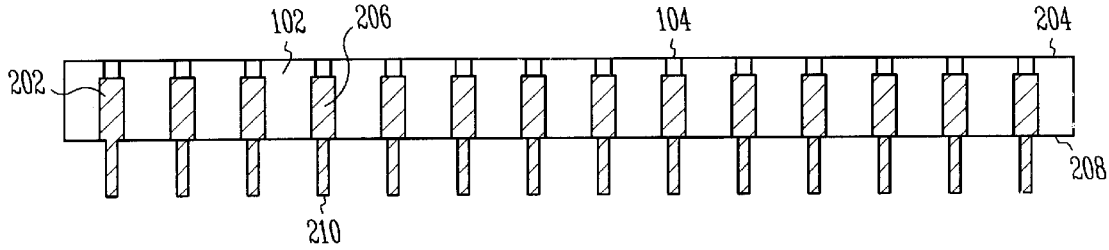
Fig.2 (PRIOR ART)
FIG. 2 illustrates a cross-sectional, side view of the socket of FIG. 1 along section line A—A.
Figure 3:
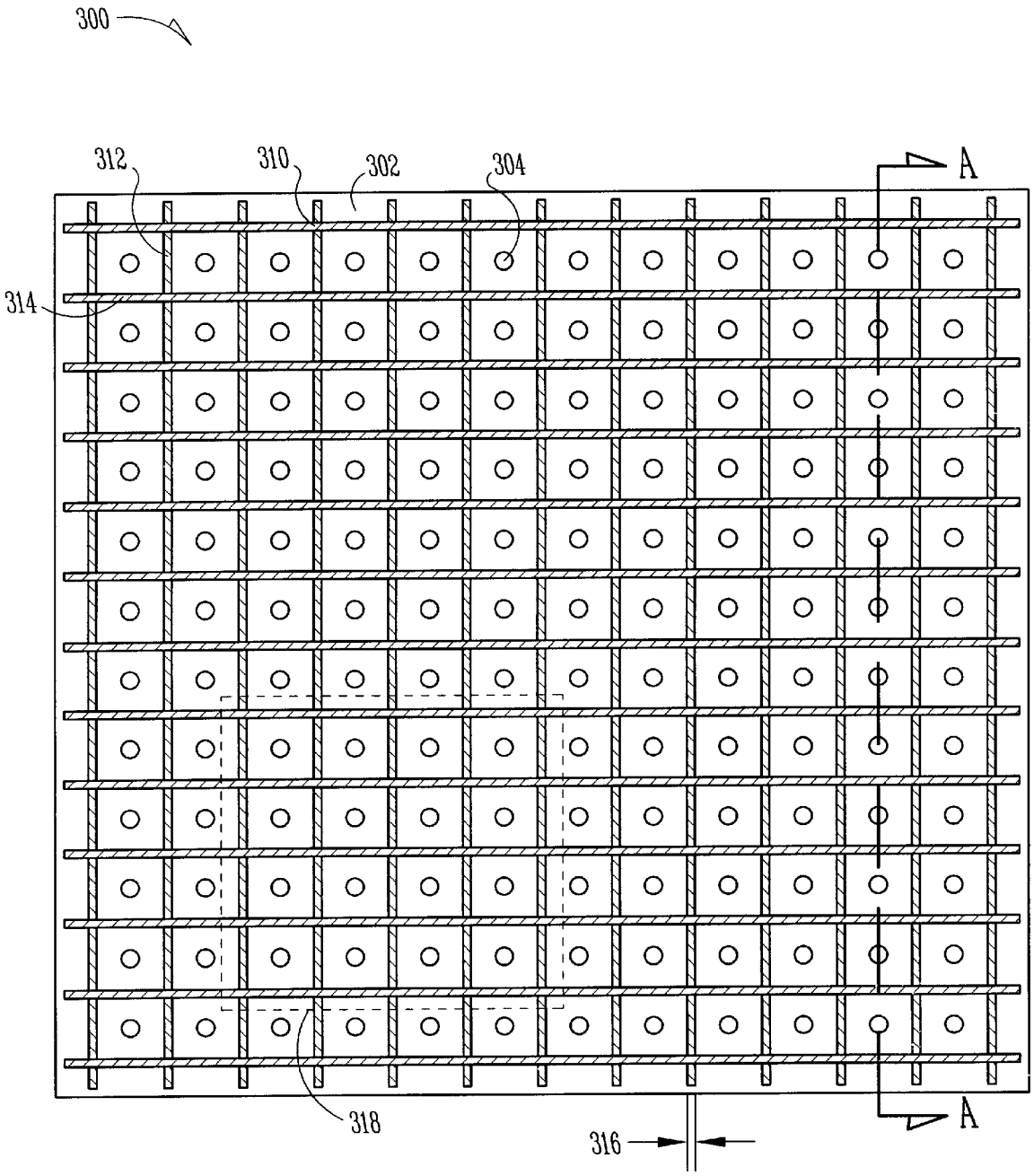
FIG. 3 illustrates a schematic, top view of a socket in accordance with one embodiment of the present invention.

FIG. 3 illustrates a schematic, top view of a socket 300 in accordance with one embodiment of the present invention. Socket 300 includes a rigid housing 302 having a top surface, which defines a package mounting surface. In one embodiment, housing 302 is formed of a polymer material, such as a thermoplastic or thermosetting material. For example, some common socket housing materials include standard FR-4 epoxy, polyamides, BT, polybutylene terepthalate (PBT), polyethylene terepthalate (PET), polycyclohexylenedimethylene terepthalate (PCT), polyphenylene sulfide (PPS), cyanate ester, and liquid crystal polymers, although other materials could be used as well.

An array of openings 304 in the top surface of housing 302 corresponds to an array of pins in a package that is mountable on socket 300. In addition, the array of openings 304 provides access to a corresponding array of contacts in an interior of the housing. The array of openings 304 is arranged in a square pitch pattern in the embodiment shown. Accordingly, the openings 304 form columns and rows of openings.

Although FIG. 3 shows twelve columns and rows of openings 304, other socket designs could have more or fewer columns and/or rows of openings. Also, each column or row need not have an equal number of openings 304.

In other embodiments, the array of openings 304 could be arranged in a pattern other than a square pitch pattern. For example, the openings 304 could be arranged in an interstitial pattern (see FIGS. 12 and 14, for example) or some other pattern. In addition, some socket designs could include a hole in the center of the socket (see FIGS. 11, 12, and 14, for example).

Socket 300 also includes a conductive structure 310, which includes multiple conductive walls 312, 314 embedded within the housing 302. In one embodiment, conductive structure 310 is formed from a conductive metal or alloy, such as copper, aluminum, brass, stainless steel, or other materials. Walls 312, 314 have a thickness 316 in a range of about 0.5 to 3.0 mils, in one embodiment, although they can be thicker or thinner in other embodiments. The thickness of walls 312, 314 is limited by the distance between adjacent contacts. In one embodiment, walls 312, 314 are thick enough to provide mechanical strength and stiffness to the socket.

In one embodiment, two or more of the walls 312, referred to for convenience as "column walls," are arranged in parallel and adjacent to each column of openings 304, and to contacts that are accessible through the openings 304. In addition, two or more other walls 314, referred to for convenience as "row walls," are arranged perpendicularly to the column walls, and in parallel and adjacent to each row of openings 304, and to contacts that are accessible through the openings.

In the embodiment shown, each opening 304 is surrounded by two column walls 312 and two row walls 314. Accordingly, each contact associated with an opening 304 is oriented within a "chamber," of conductive structure 310. In other embodiments, more than one contact could be arranged within a chamber. For example, two column walls and two row walls could surround two, three, four, or more contacts.

Figure 4:
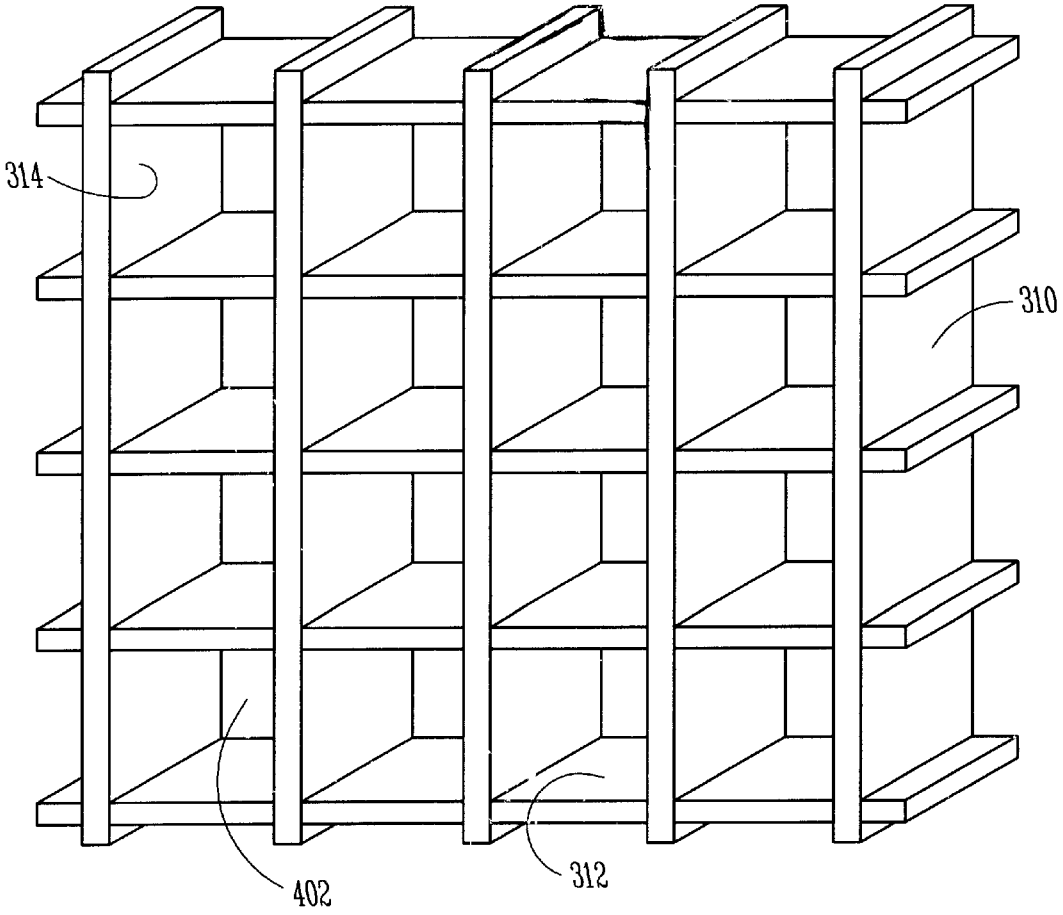
FIG. 4 illustrates an isometric view of a portion of a conductive structure in accordance with one embodiment of the present invention.

FIG. 4 illustrates an isometric view of a portion 318 (FIG. 3) of a conductive structure illustrated in FIG. 3 in accordance with one embodiment of the present invention. This view illustrates that the column walls 312 and row walls 314 form multiple, four-sided chambers 402. Within each chamber, one or more contacts are positioned. This arrangement of contacts within chambers 402 will be clarified in the description of FIG. 5, below.

In one embodiment, the column walls 312 and the row walls 314 are electrically connected at points where the walls intersect. In other embodiments, the column walls 312 and row walls 314 are not electrically connected at intersection points. As will be described in more detail later in conjunction with FIG. 8, in one embodiment, the conductive structure 310 consists of column and row walls 312, 314, which are separately formed and interlocked together to form the structure 310. In another embodiment, the column and row walls 314 are formed together as one integrated structure 310.

Figure 5:
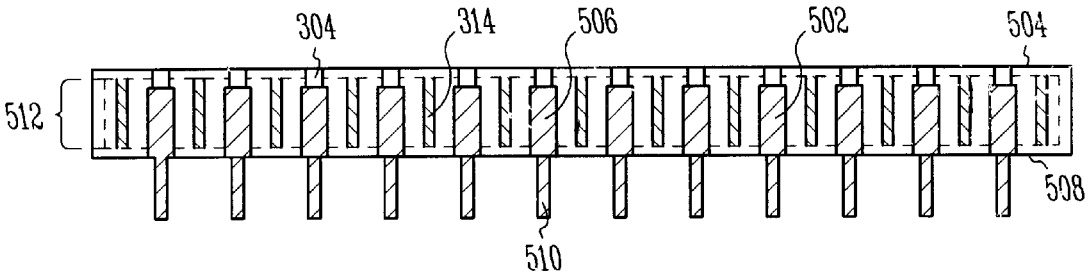
FIG. 5 illustrates a cross-sectional, side view of the socket of FIG. 3 along section line A—A.

FIG. 5 illustrates a cross-sectional, side view of the socket of FIG. 3 along section line A—A, which dissects one column of openings 304. An array of contacts 502 reside in cavities below the openings 304 in the top surface 504 of the housing. The housing captures, supports, and electrically insulates the contacts 502 from each other.

Each of the contacts 502 includes a metal body 506, which is embedded in the socket housing. In addition, in one embodiment, the socket is a PGA socket, and each contact 502 has a metallic depending lead 510, which extends in a perpendicular direction from the bottom surface 508 and is insertable in a through-hole of a circuit board substrate.

Figure 17:
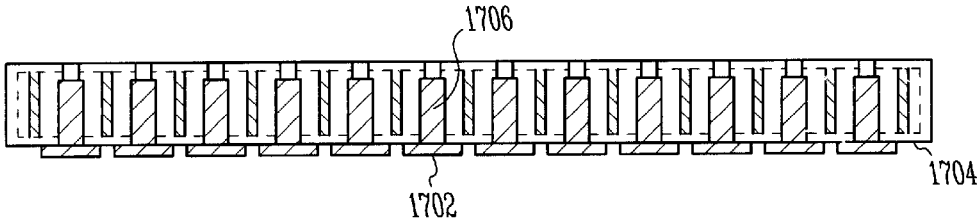
FIG. 17 illustrates a cross-sectional, side view of a socket in accordance with an alternate embodiment of the present invention.

In an alternate embodiment, the socket is a ball grid array (BGA) socket, and depending leads 510 are replaced by bond pads (not shown) formed on the bottom surface 508 and electrically connected to the contacts.

with:

In an alternate embodiment, as illustrated in FIG. 17, the socket is a ball grid array (BGA) socket, and depending leads 510 are replaced by bond pads 1702 formed on the bottom surface 1704 and electrically connected to the contacts 1706.

The metal contact body 506 is configured to allow insertion of a pin of the PGA package into the opening in which the metal body 508 is positioned (or into a cavity in the metal body 508, itself). When the pins of a PGA package are inserted in the socket, the PGA package pins physically and electrically contact the metal bodies 506, enabling signals, power, and ground to be exchanged between the circuit board and the PGA package. Accordingly, some of the contacts 502 are ground conducting contacts, some of the contacts 502 are signal carrying contacts, and some of the contacts 502 are power conducting contacts.

Walls 314 of the conductive structure are located between and adjacent to the column of contacts 502. Walls 314 are embedded within the housing along planes that are perpendicular to the top surface 504 and the bottom surface 508. Walls 314 are electrically isolated from the signal carrying and power conducting contacts by the dielectric material that forms the housing. In addition, in one embodiment, at least one of the walls 314 (or walls 312, FIG. 3) is electrically connected to at least one of the ground conducting contacts. In this manner, the conductive structure is grounded, and is insulated from the signal carrying and power conducting contacts. In another embodiment, the ground conducting contacts are not electrically connected to the walls 314 (or walls 312).

The height 512 of walls 314 is in a range of 10% to 100% of the height of the housing. In other embodiments, the height 512 of walls 314 is greater or smaller than this range. The dimensions of the socket housing can vary greatly, depending on the number and pattern of openings, the size of the package to be mounted on the socket, rigidity requirements, and other factors. For example, a typical socket housing could have a top surface that has a length and width in a range of 1–3 inches, and sides that are in a range of 0.1 to 0.25 inches deep, although a socket could have larger and/or smaller dimensions as well.

Figure 6:
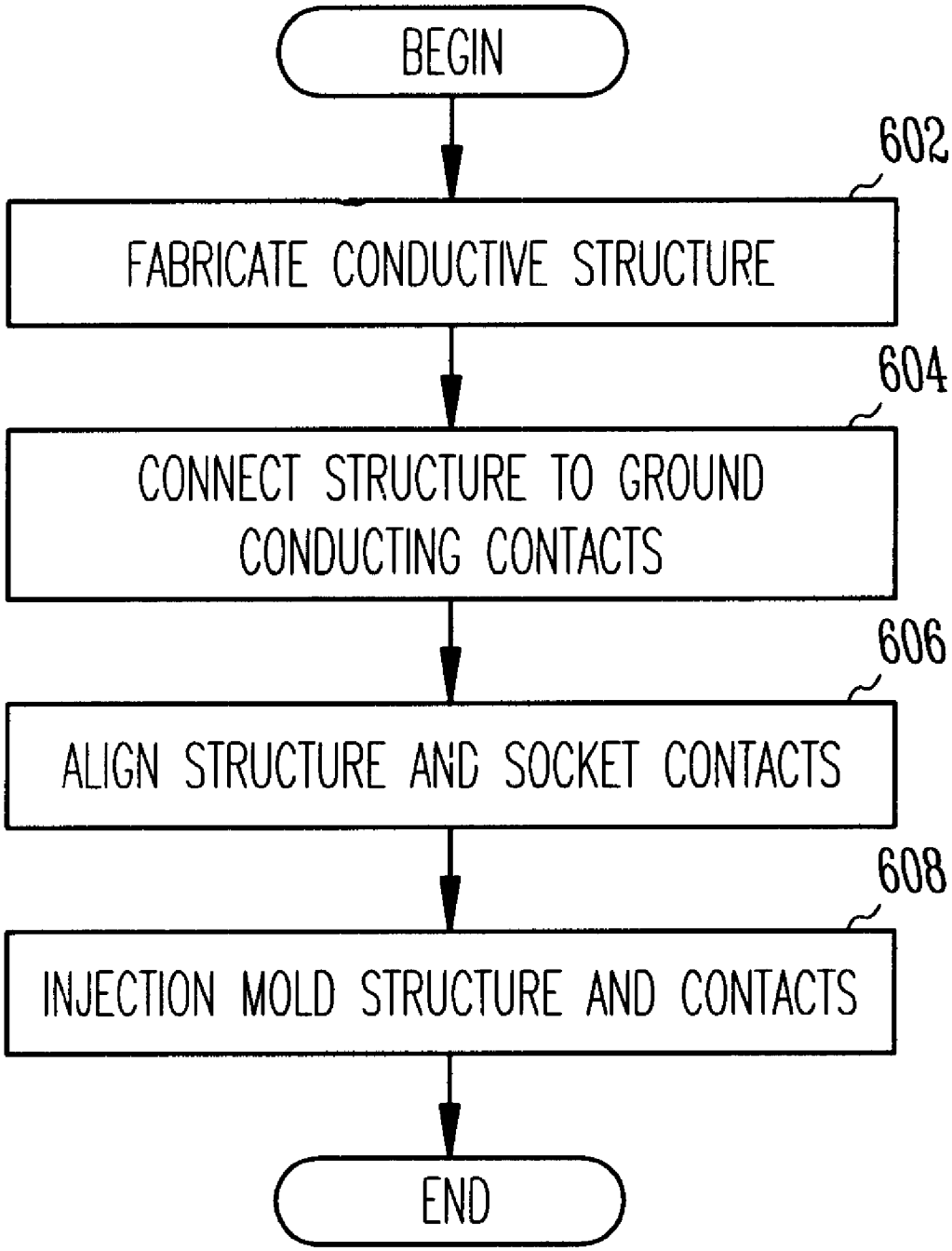
FIG. 6 illustrates a flowchart of a method for fabricating a socket in accordance with one embodiment of the present invention.

FIG. 6 illustrates a flowchart of a method for fabricating a socket in accordance with one embodiment of the present invention. FIG. 6 should be viewed in conjunction with FIGS. 7–11, which illustrate various stages of fabricating a socket in accordance with one embodiment of the present invention.

Figure 7:
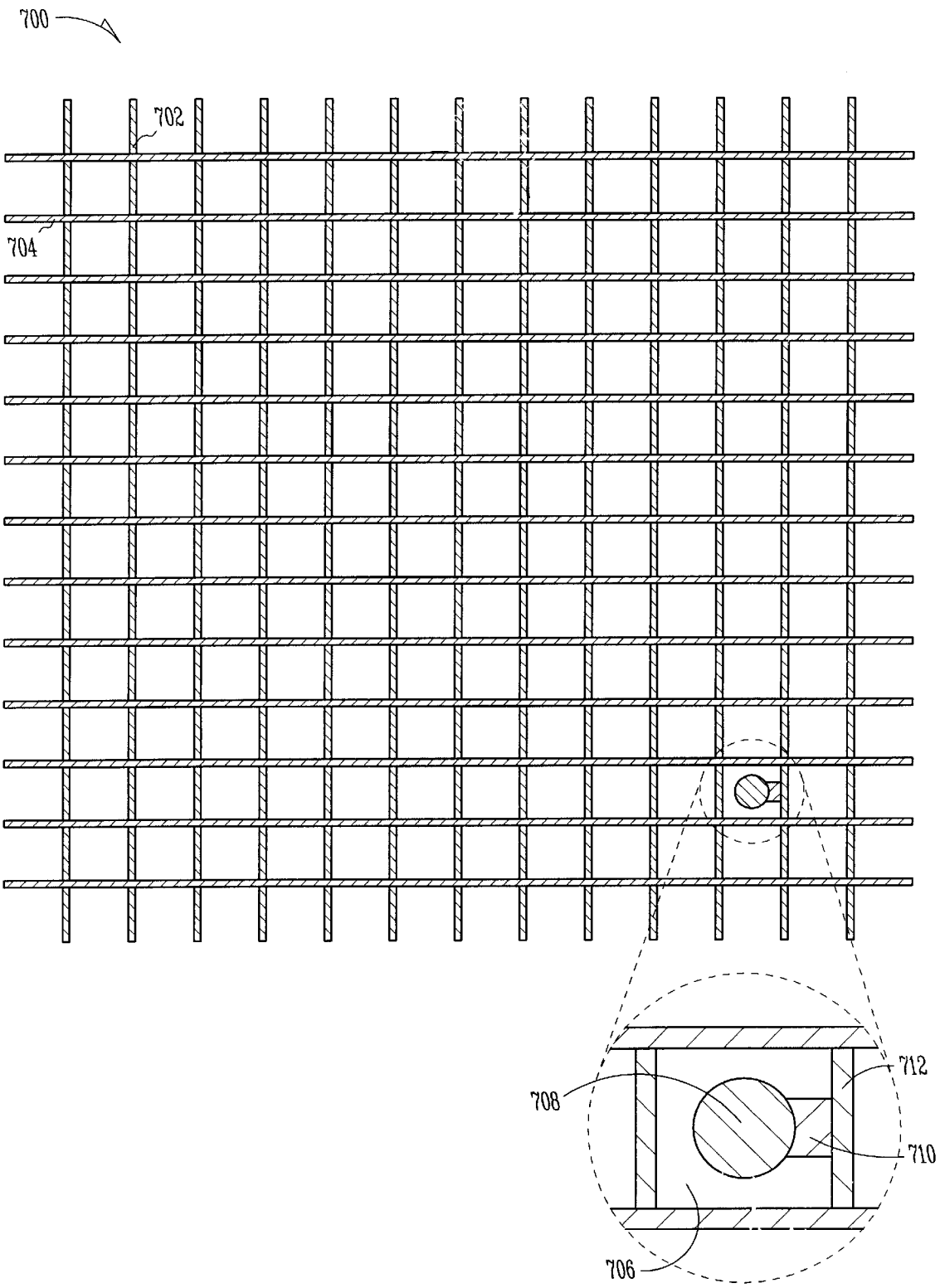
FIGS. 7–10 illustrate various stages of fabricating a socket in accordance with one embodiment of the present invention.

The method begins, in block 602, by fabricating a conductive structure 700 (FIG. 7). As described previously, the conductive structure 700 is formed from a metal or alloy, such as copper, aluminum, brass, stainless steel, or other materials. Conductive structure 700 includes two or more column walls 702 and two or more row walls 704.

Figure 8:
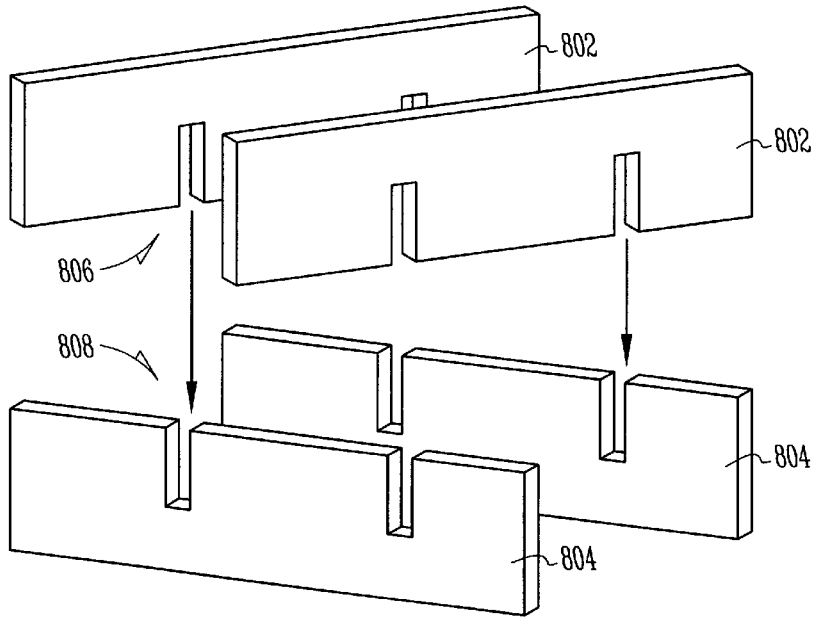

FIG. 8 illustrates an exploded view of portions of column walls 802 and row walls 804, in accordance with one embodiment. Column walls 802 and row walls 804 are separately formed, in this embodiment, using a metal stamping, cutting, casting, or plating process. Each column wall 802 includes two or more notches 806, which interlock with complementary notches 808 in row walls 804, when the column walls 802 and row walls 804 are brought together, as indicated by the arrows. Once the column walls 802 and row walls 804 are interlocked, they form a rigid conductive structure.

In another embodiment, column walls 802 and row walls 804 can be formed together as an integrated structure. For example, the structure could be cast from a molten metal and allowed to cool to form an integrated structure.

Referring back to FIG. 6, the conductive structure is electrically connected to one or more ground conducting contacts, in block 604. In one embodiment, the contacts are welded or soldered to the conductive structure in positions that the contacts will permanently assume. FIG. 7 illustrates an enlarged view of a chamber 706 of structure 700, which includes a contact 708 electrically connected to a wall 712 of the chamber. In one embodiment, a conductive contact 708 is positioned between the wall 712 and contact 708, to ensure proper positioning of spacer 710 within chamber 706. In another embodiment, contact 708 could be specifically designed with an extension that performs the function of spacer 710. In still another embodiment, where the walls 702, 704 of conductive structure 700 are formed together as an integrated structure, contacts 708 also could be formed as an integrated portion of the structure.

Although FIG. 7 illustrates only a single ground conducting contact 708 Gus electrically connected to structure 700, additional ground conducting contacts (not shown) also could be electrically connected to structure 700. In one embodiment, all ground conducting contacts are electrically connected to structure 700.

Figure 9:
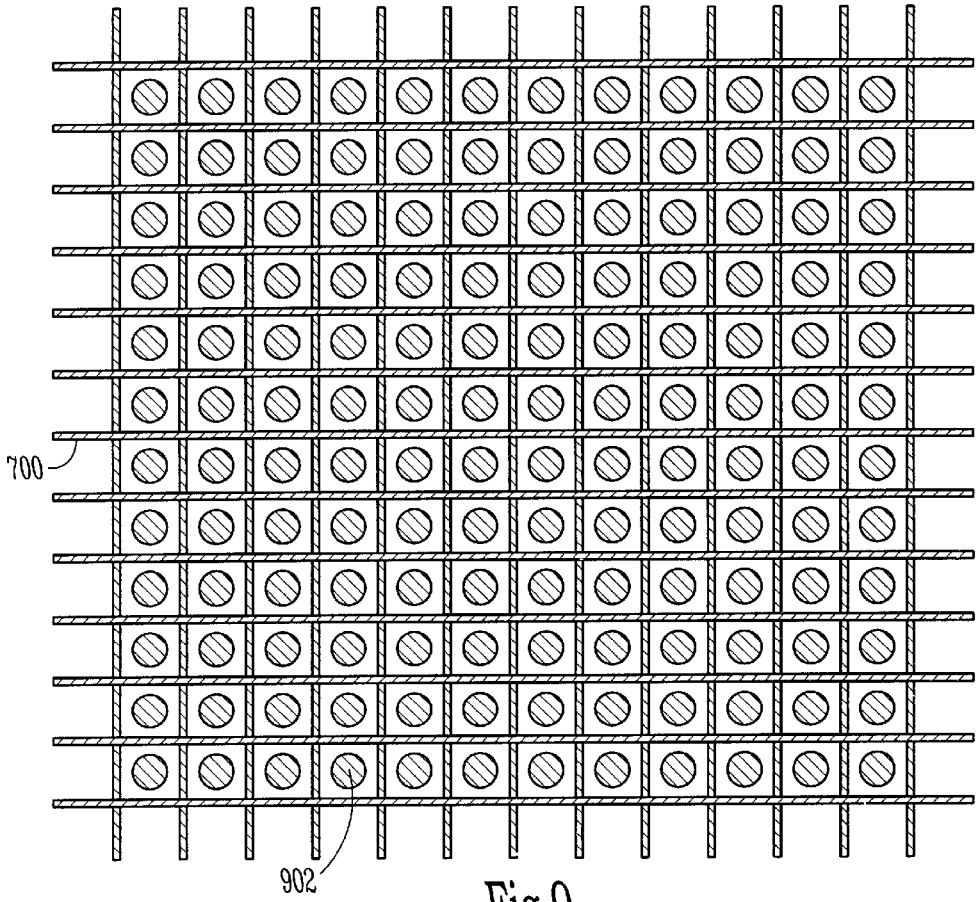
Figure 10:
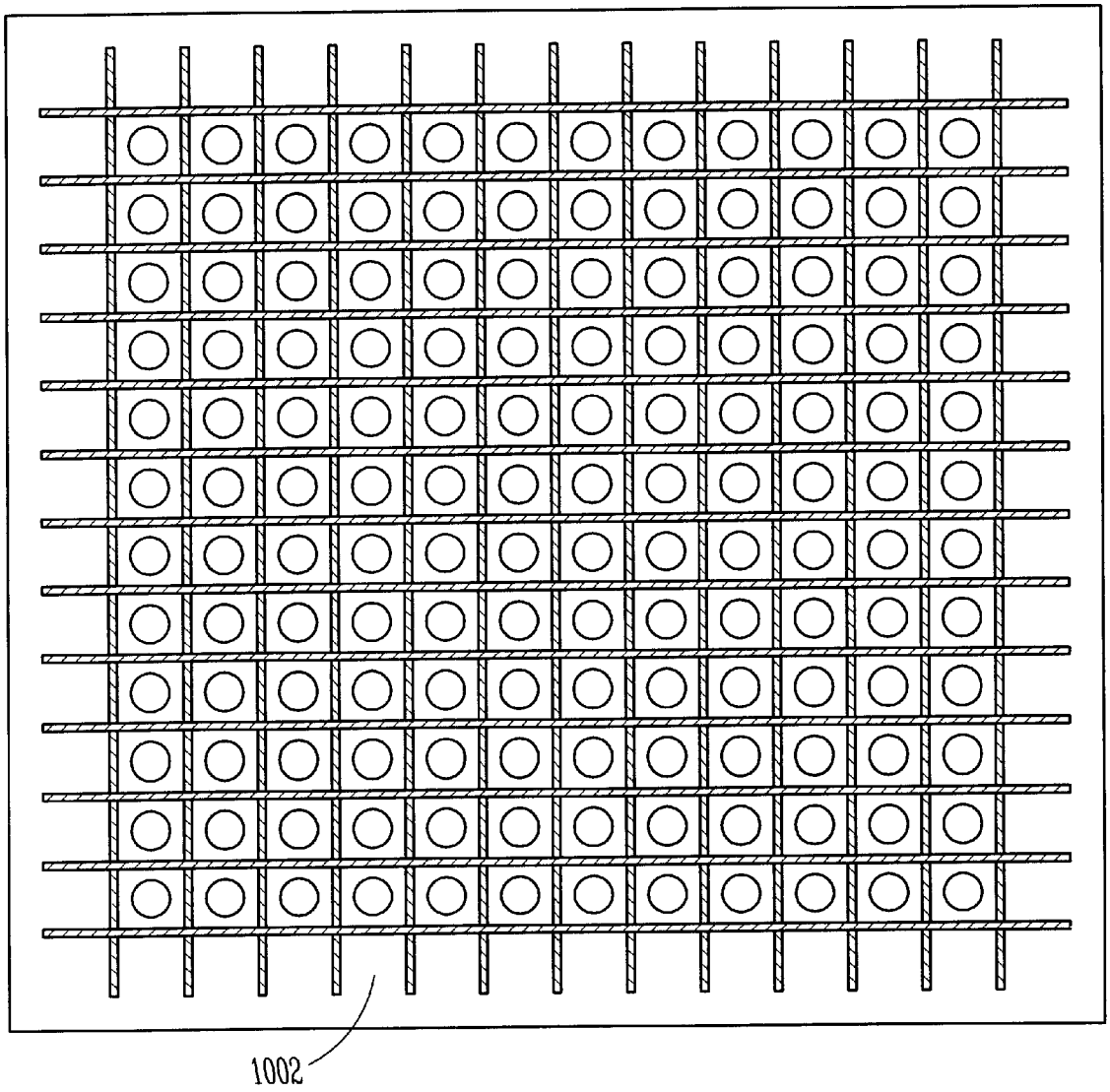

Referring again to FIG. 6, the conductive structure is then embedded in a housing. In one embodiment, embedding the conductive structure in the housing begins by aligning the conductive structure 700 in a mold, in block 606, along with the array of the remaining socket contacts 902 (FIG. 9).

In block 608, an injection molding process is then performed to form the housing 1002 (FIG. 10) around the aligned structure and contacts. Once cooled, the assembly forms a rigid socket 1000 with an embedded conductive structure, in accordance with one embodiment, and the method ends.

In alternate embodiments, the conductive structure and/or some or all of the contacts could be inserted into the socket after the housing material is molded. For example, in one alternate embodiment, the housing material is injection molded with a pattern of trenches that are arranged in a complementary manner to the conductive structure. The conductive structure is then embedded within the housing by inserting the conductive structure in the trenches. In another alternate embodiment, the socket is injection molded with openings in the bottom surface, which accommodate later insertion of contacts. Alternatively, the bottom (or top) openings or trenches could be drilled, pressed or punched in the housing material after injection molding.

The Figures and associated description, above, discuss the structure, materials, and fabrication of a socket having a square pitch pattern of contacts, where an equal number of contacts are positioned within each row or column. In alternate embodiments, the various embodiments of the present invention could be used in a socket that has a different pattern of contacts and/or an unequal number of contacts within each row or column. In addition, a socket in accordance with the various embodiments could include a hole in the center of the socket.

Figure 11:
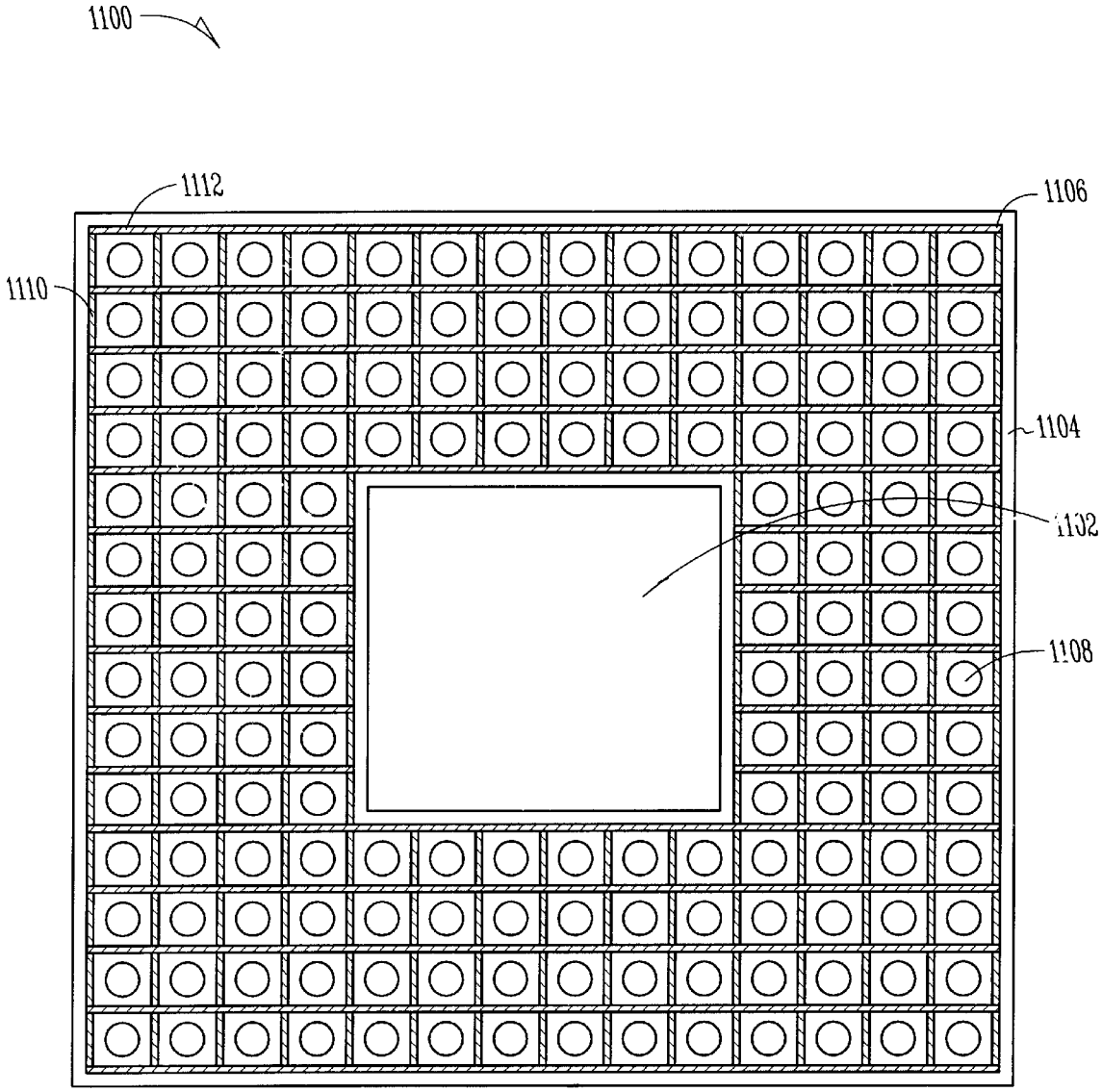
FIG. 11 illustrates a top view of a square pitch socket in accordance with another embodiment of the present invention.

FIG. 11 illustrates a top view of a square pitch socket 1100 in accordance with another embodiment of the present invention. Socket 1100 includes a hole 1102 roughly in the center of the socket. Socket 1100 also includes housing material 1104, a conductive structure 1106 embedded within the housing material 1104, and an array of openings 1108 in the housing material 1104. The array of openings 1108 provides access to contacts (not shown) below the openings 1108.

The design of conductive structure 1106 can be similar to the conductive structure designs described in conjunction with various embodiments, above. However, those column walls 1110 and row walls 1112 that would otherwise intersect the hole 1102 instead terminate before the hole 1102. Accordingly, conductive structure 1106 also includes a hole roughly in the center of the structure.

Figure 12:
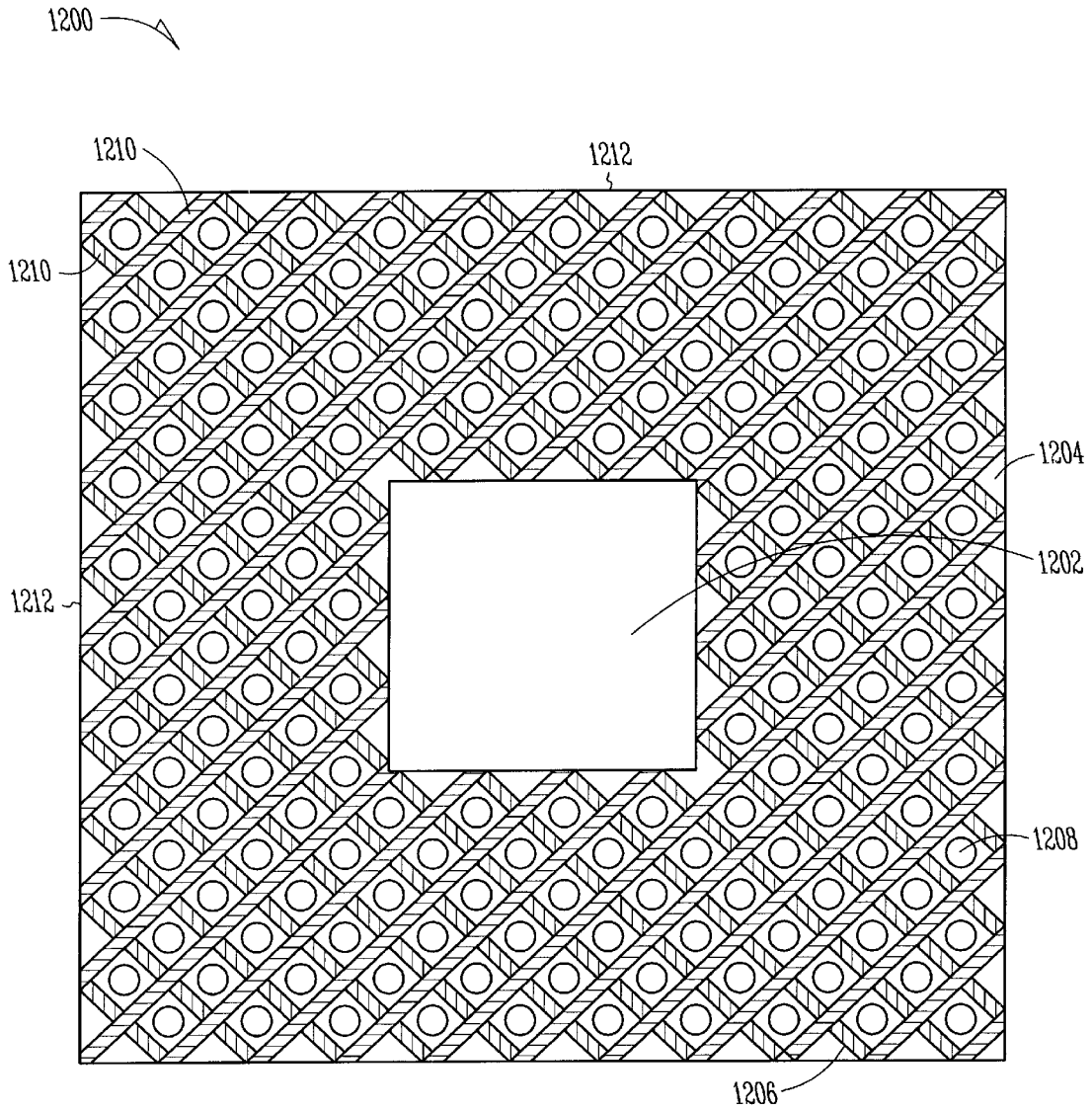
FIG. 12 illustrates a top view of an interstitial pitch socket in accordance with another embodiment of the present invention.

FIG. 12 illustrates a top view of an interstitial pitch socket 1200 in accordance with another embodiment of the present invention. An interstitial pitch pattern differs from a square pitch pattern in that each consecutive column and row of openings are offset from adjacent columns and rows by half the pitch (i.e., the center-to-center distance) of the openings.

Socket 1200 includes a hole 1202 roughly in the center of the socket, in one embodiment. Socket 1200 also includes housing material 1204, a conductive structure 1206 embedded within the housing material 1204, and an array of openings 1208 in the housing material 1204. The array of openings 1208 provides access to contacts (not shown) below the openings 1208.

The design of conductive structure 1206 can be similar to the conductive structure designs described in conjunction with various embodiments, above. Because of the interstitial pitch pattern of the openings 1208, however, the walls 1210 of conductive structure 1206 run diagonally to the sides 1212 of socket 1200, rather than being parallel to the sides, as is the case with a square pitch design.

As described previously, one or more ground conducting contacts (e.g., contact 708, FIG. 7) are connected to the conductive structure in order to ground the structure. In the embodiments previously described, the ground conducting contacts are arranged roughly in the center of the chambers (e.g., chamber 706, FIG. 7) of the conductive structure. In alternate embodiments, the ground conducting contacts could be arranged off center, or the walls of the conductive structure could intersect at least some of the ground conducting contacts, as is shown in FIGS. 13 and 14.

Figure 13:
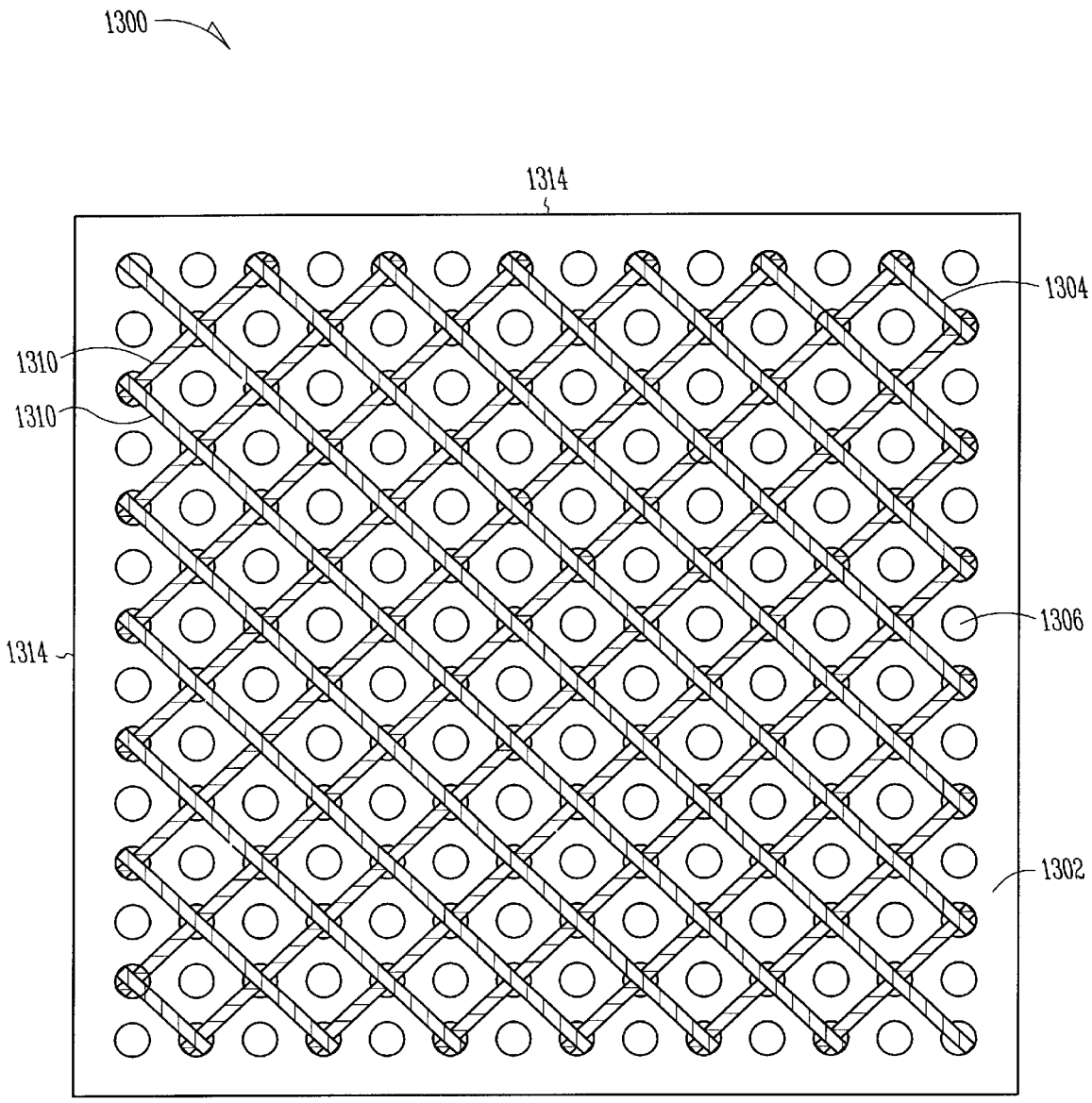
FIG. 13 illustrates a top view of a square pitch socket in accordance with another embodiment of the present invention.

FIG. 13 illustrates a top view of a square pitch socket 1300 in accordance with another embodiment of the present invention. Socket 1300 includes housing material 1302, a conductive structure 1304 embedded within the housing material 1302, and an array of openings 1306 in the housing material 1302. The array of openings 1306 provides access to contacts (not shown) below the openings 1306.

The design of conductive structure 1304 can be similar to the conductive structure designs described in conjunction with various embodiments, above. However, the walls 1310 of the structure 1304 intersect the ground conducting contacts, rather than running adjacent to the columns and rows of contacts. In many contact configurations, every other contact is designated a ground conducting contact, in both the column and row directions. Accordingly, "columns" and "rows" of ground conducting contacts run diagonally from the sides 1314 of the socket 1300. Because the walls 1310 intersect the ground conducting contacts, the walls 1310 also run diagonally.

Figure 14:
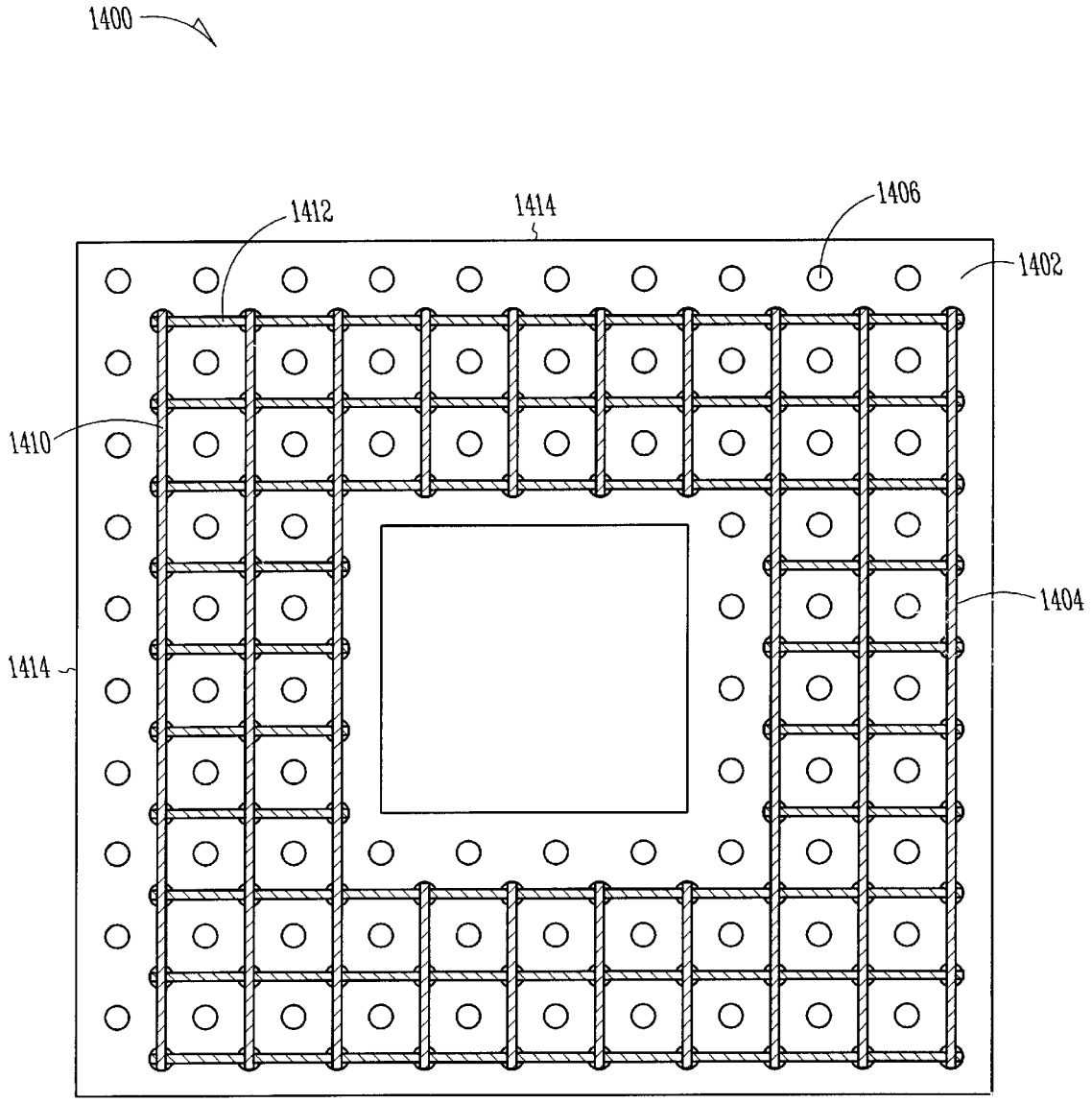
FIG. 14 illustrates a top view of an interstitial pitch socket in accordance with another embodiment of the present invention.

FIG. 14 illustrates a top view of an interstitial pitch socket 1400 in accordance with another embodiment of the present invention. Socket 1400 includes housing material 1402, a conductive structure 1404 embedded within the housing material 1402, and an array of openings 1406 in the housing material 1402. The array of openings 1406 provides access to contacts (not shown) below the openings 1406.

The design of conductive structure 1404 can be similar to the conductive structure designs described in conjunction with various embodiments, above. However, the column and row walls 1410, 1412 intersect the ground conducting contacts, rather than running adjacent to the columns and rows of contacts. In the case of an interstitial design where every other contact is designated a ground conducting contact, the ground conducting contacts run parallel to the sides 1414 of the socket 1400. Because the walls 1410, 1412 intersect the ground conducting contacts, the walls 1410, 1412 also run parallel to the sides 1414.

In one embodiment, the ground conducting contacts associated with the embodiments shown in FIGS. 13 and 14 are particularly designed to accommodate connections to the conductive structures 1304, 1404. Referring also to FIG. 6, in one embodiment, the processes of connecting (block 604) the conductive structure to the ground conducting contacts, and aligning (block 606) the structure and the remaining socket contacts (e.g., the signal or power contacts) are performed at the same time. In another embodiment, the ground conducting contacts can be connected as a separate process, as described previously in conjunction with FIG. 6.

Figure 15:
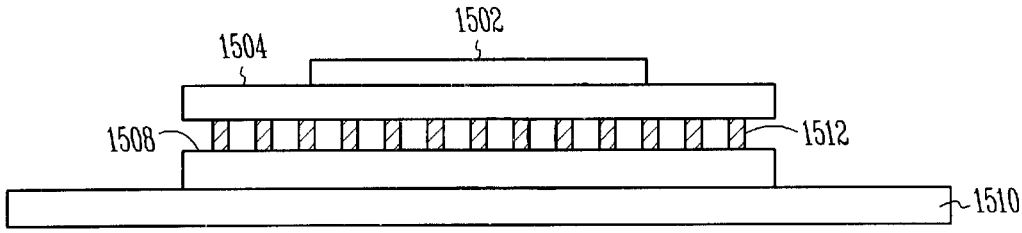
FIG. 15 illustrates an integrated circuit package, socket, and printed circuit board, where the socket includes an embedded conductive structure in accordance with one embodiment of the present invention.

FIG. 15 illustrates an integrated circuit package 1504, socket 1508, and PC board 1510, where the socket 1508 includes an embedded conductive structure in accordance with various embodiments of the present invention. Starting from the top of FIG. 15, an integrated circuit 1502 is housed by integrated circuit package 1504. Integrated circuit 1502 contains one or more circuits, which are electrically connected to integrated circuit package 1504 by various technologies, as explained below.

Integrated circuit 1502 could be any of a number of types of integrated circuits. In one embodiment of the present invention, integrated circuit 1502 is a microprocessor, although integrated circuit 1502 could be a memory device, application specific integrated circuit, digital signal processor, or another type of device in other embodiments. In the example shown, integrated circuit 1502 is a "flip chip" type of integrated circuit, meaning that the input/output terminations on the chip can occur at any point on its surface. After the chip has been readied for attachment to integrated circuit package 1504, it is flipped over and attached, via solder bumps or balls to matching pads on the top surface of integrated circuit package 1504. Alternatively, integrated circuit 1502 could be wire bonded, where input/output terminations are connected to integrated circuit package 1504 using bond wires to pads on the top surface of integrated circuit package 1504.

Integrated circuit package 1504 is coupled to PC board 1510 through a socket 1508 on PC board 1510. In the example shown, package 1504 includes contact pins 1512, which mate with complementary contact openings in socket 1508.

Printed circuit board 1510 could be, for example, a motherboard of a computer system. As such, it acts as a vehicle to supply power, ground, and signals to integrated circuit 1502. These power, ground, and other signals are supplied through traces or planes (not shown) on or within PC board 1510, socket 1508, contact pins 1512, and integrated circuit package 1504.

Figure 16:
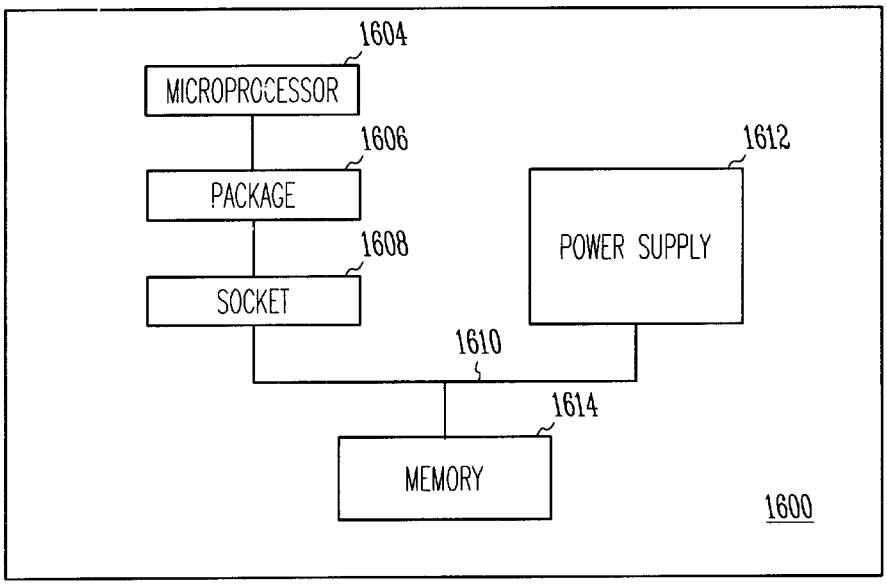
FIG. 16 illustrates a general-purpose electronic system in accordance with one embodiment of the present invention.

The configuration described above in conjunction with various embodiments could form part of a general purpose electronic system. FIG. 16 illustrates a general-purpose electronic system 1600 in accordance with one embodiment of the present invention. System 1600 could be, for example, a computer, a wireless or wired communication device (e.g., telephone, modem, cell phone, pager, radio, etc.), a television, a monitor, or virtually any other type of electronic system.

The electronic system is housed on one or more PC boards, and includes microprocessor 1604, integrated circuit package 1606, socket 1608, bus 1610, and memory 1614. Socket 1608 includes an embedded conductive structure, as described previously in accordance with various embodiments of the present invention. Integrated circuit package 1606 and socket 1608 couple microprocessor 1604 to bus 1610 in order to deliver data between microprocessor 1604 and devices coupled to bus 1610. In one embodiment, bus 1610 couples microprocessor 1604 to memory 1614.

Conclusion

The use of the conductive structure described in the various embodiments has several advantages. First, the conductive structure effectively functions as a ground plane structure that surrounds each signal carrying and power conducting contact in directions that are perpendicular to the axis of the contact's metal body and depending lead. This leads to more effective grounding, which enables fewer contacts to be allocated as ground conducting contacts, without a sacrifice in performance. Accordingly, the various embodiments enable the signal/ground ratio to be increased.

In addition, the conductive structure provides a more effective current return path for signals, thus lowering the loop inductance of the socket. The effective inductance of each signal carrying contact drops, using the embodiments of the present invention, due to the increased coupling to ground.

The conductive structure also helps to control the impedance of the socket through a consistent spacing between signal carrying contacts and ground. In other words, in the embodiment where each signal carrying and power conducting contact is surrounded by walls of the conductive structure, the distance between every signal carrying and power conducting contact and ground is equal. The conductive structure reduces self inductance and increases self capacitance, thus reducing the socket's impedance significantly. As result of the effective grounding provided by the conductive structure, the capacitance of the socket also increases, thus helping to control the characteristic impedance of the socket.

In addition, crosstalk between signal carrying contacts is significantly reduced through the reduction in capacitive and inductive mutual coupling. Finally, electromagnetic interference (EMI) emissions from the socket are reduced, due to the efficient grounding of pins uniformly across the socket. The beneficial effects of the various embodiments are similar for power delivery, because there is higher coupling between power and ground pins through the conductive structure.

Use of the conductive structure of the various embodiments also improves the mechanical performance of the socket in several ways. First, the conductive structure forms internal reinforcement, which strengthens the socket. Second, socket reliability is improved, because the conductive structure helps to reduce socket-to-board coefficient of thermal expansion (CTE) mismatches, which are present using prior art sockets. Third, the conductive structure can allow a reduction in the height of the contact leads, because less lead height is required to overcome CTE mismatches.

Various embodiments of a PGA socket and methods of fabricating that socket have been described, along with a description of the incorporation of the socket within a general-purpose electronic system. While the foregoing examples of dimensions and ranges are considered typical, the various embodiments of the invention are not limited to such dimensions or ranges. It is recognized that the trend within industry is to generally reduce device dimensions for the associated cost and performance benefits.

In the foregoing detailed description of the preferred embodiments, reference is made to the accompanying drawings, which form a part hereof, and in which are shown by way of illustration specific preferred embodiments in which the invention may be practiced. These embodiments are described in sufficient detail to enable those skilled in the art to practice the invention.

It will be appreciated by those of ordinary skill in the art that any arrangement, which is calculated to achieve the same purpose, may be substituted for the specific embodiment shown. For example, an embedded conductive structure could have different relative dimensions from the dimensions shown in the Figures. In addition, although the Figures show each of the structure's chambers surrounding only a single contact, at least some of the chambers could include two or more contacts. Finally, the structure could be fabricated of any suitable conductive materials, and could be assembled in different ways from those specifically described herein.

The various embodiments have been described in the context of PGA sockets. One of ordinary skill in the art would understand, based on the description herein, that the method and apparatus of the present invention could also be applied in many other applications where it is desired to reduce crosstalk between adjacent signal carrying contacts or vias. Therefore, all such applications are intended to fall within the spirit and scope of the present invention. For example, the conductive structure could be embedded in sockets or other housings that are other than PGA sockets, such as BGA sockets, for example. Accordingly, the socket contacts would not include depending leads, but instead would have bond pads on the bottom surface of the socket. In another embodiment, the conductive structure could be used in an integrated circuit package to surround signal carrying, ground conducting, and/or power conducting vias.

This application is intended to cover any adaptations or variations of the present invention. The foregoing detailed description is, therefore, not to be taken in a limiting sense, and it will be readily understood by those skilled in the art that various other changes in the details, materials, and arrangements of the parts and steps which have been described and illustrated in order to explain the nature of this invention may be made without departing from the spirit and scope of the invention as expressed in the adjoining claims.

What is claimed is:

1. A socket comprising:

a housing having a top surface and a bottom surface;

multiple contacts embedded within the housing, wherein one or more of the multiple contacts are ground conducting contacts, one or more of the multiple contacts are signal carrying contacts, and each contact includes a metal body embedded within the housing; and a conductive structure that includes multiple conductive walls embedded within the housing along planes that are perpendicular to the top surface and the bottom surface, wherein the multiple conductive walls are electrically isolated from the signal carrying contacts and are adjacent to at least some of the signal carrying contacts, and wherein at least one of the multiple conductive walls is electrically connected to at least one of the ground conducting contacts, and wherein the multiple conductive walls include multiple first walls arranged in parallel to each other, and multiple second walls arranged perpendicularly to the multiple first walls, and wherein each of the multiple first walls is electrically connected to two or more of the multiple second walls at two or more intersection points.

2. The socket as claimed in claim 1, wherein the multiple first walls and the multiple second walls form multiple, four-sided chambers within which the signal carrying contacts are positioned.

3. The socket as claimed in claim 2, wherein at least some of the multiple, four-sided chambers include a single contact.

4. The socket as claimed in claim 2, wherein at least some of the multiple, four-sided chambers include two or more contacts.

5. The socket as claimed in claim 1, wherein the at least some of the multiple first walls run adjacent to rows and columns of contacts.

6. The socket as claimed in claim 1, wherein the at least some of the multiple first walls intersect at least some of the ground conducting contacts.

7. The socket as claimed in claim 1, wherein the socket is a pin grid array socket, and each of the multiple contacts includes a lead that extends in a perpendicular direction from the bottom surface of the housing.

8. The socket as claimed in claim 1, wherein the socket is a ball grid array socket, and the socket further comprises multiple bond pads on the bottom surface of the housing and electrically connected to the multiple contacts.

9. The socket as claimed in claim 1, wherein the conductive structure is formed from one or more materials in a group of materials that includes copper, aluminum, brass, and stainless steel.

10. The socket as claimed in claim 1, wherein a height of the conductive structure is in a range of 10% to 100% of a height of the housing.

11. The socket as claimed in claim 1, wherein a thickness of the multiple first walls is in a range of 0.5 to 3.0 mils.

12. An electronic system comprising:

a microprocessor;

an integrated circuit package within which the microprocessor is housed; and a socket, within which pins of the package are inserted, wherein the socket includes a housing having a top surface and a bottom surface, multiple contacts embedded within the housing, wherein one or more of the multiple contacts are ground conducting contacts, one or more of the multiple contacts are signal carrying contacts, and each contact includes a metal body embedded within the housing, and a conductive structure that includes multiple conductive walls embedded within the housing along planes that are perpendicular to the top surface and the bottom surface, wherein the multiple conductive walls are electrically isolated from the signal carrying contacts and are adjacent to at least some of the signal carrying contacts, and wherein at least one of the multiple conductive walls is electrically connected to at least one of the ground conducting contacts, and wherein the multiple conductive walls comprise multiple first walls arranged in parallel to each other, and multiple second walls arranged perpendicularly to the multiple first walls, and wherein each of the multiple first walls is electrically connected to two or more of the multiple second walls at two or more intersection points.

13. The electronic system as claimed in claim 12, wherein the socket is a pin grid array socket, and each of the multiple contacts includes a lead that extends in a direction perpendicular to the bottom surface of the housing.

14. The socket as claimed in claim 1, wherein each of the multiple first walls and the multiple second walls are separately formed and interlock to form the conductive structure.

* * * * *

UNITED STATES PATENT AND TRADEMARK OFFICE

CERTIFICATE OF CORRECTION

PATENT NO. : 6,428,358 B1 
DATED : August 6, 2002
INVENTOR(S) : David G. Figueroa et al.

It is certified that error appears in the above-identified patent and that said Letters Patent is hereby corrected as shown below:

Title page, Item [54] and Column 1, lines 1-3,
Delete the title "SOCKET WITH EMBEDDED CONDUCTIVE STRUCTURE AND METHOD OF FABRICATION THEREFOR" and insert -- SOCKET WITH EMBEDDED CONDUCTIVE STRUCTURE --, therefor.

Column 4,
Lines 50-54, delete the following paragraph:

> "In an alternative embodiment, the socket is a ball grid array (BGA) socket, and depending leads 510 are replaced by bond pads (not shown) formed on the bottom surface 508 and electrically connected to the contacts.
> with:"

Line 59, insert -- Using a BGA socket, the socket would be soldered to a circuit board substrate. -- after "the contacts 1706".

Column 6,
Line 6, delete "Gus" after "708".

Signed and Sealed this

Eleventh Day of March, 2003

JAMES E. ROGAN
*Director of the United States Patent and Trademark Office*